US011725313B2

(12) United States Patent
Wörnle et al.

(10) Patent No.: US 11,725,313 B2
(45) Date of Patent: Aug. 15, 2023

(54) METHOD AND KNITTING DEVICE FOR PLATING ON A CIRCULAR KNITTING MACHINE EQUIPPED WITH COMPOUND NEEDLES

(71) Applicant: Groz-Beckert KG, Albstadt (DE)

(72) Inventors: Martin Wörnle, Mössingen (DE); Roland Simmendinger, Hohenzollern (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 17/619,965

(22) PCT Filed: May 28, 2020

(86) PCT No.: PCT/EP2020/064922
§ 371 (c)(1),
(2) Date: Dec. 16, 2021

(87) PCT Pub. No.: WO2020/254089
PCT Pub. Date: Dec. 24, 2020

(65) Prior Publication Data

US 2022/0205153 A1 Jun. 30, 2022

(30) Foreign Application Priority Data

Jun. 17, 2019 (EP) ..... 19180536

(51) Int. Cl.
*D04B 9/34* (2006.01)
*D04B 9/10* (2006.01)
*D04B 15/06* (2006.01)

(52) U.S. Cl.
CPC ..... *D04B 9/34* (2013.01); *D04B 9/10* (2013.01); *D04B 15/06* (2013.01)

(58) Field of Classification Search
CPC . D04B 9/34; D04B 9/10; D04B 15/06; D04B 35/06
(Continued)

(56) References Cited

U.S. PATENT DOCUMENTS 1,441,110 A * 1/1923 O'Lena ..... D04B 7/12 66/93
2,050,962 A * 8/1936 Page ..... D04B 9/26 66/107
(Continued)

FOREIGN PATENT DOCUMENTS

DE 4131508 A1 3/1993
DE 69024050 T2 6/1996
(Continued)

OTHER PUBLICATIONS

International Search Report and Written Opinion dated Aug. 20, 2020, in corresponding International Application No. PCT/EP2020/064922, with machine English translation (17 pages).
(Continued)

*Primary Examiner* — Danny Worrell
*Assistant Examiner* — Aiying Zhao
(74) *Attorney, Agent, or Firm* — Fitch, Even, Tabin & Flannery LLP

(57) ABSTRACT

A method and a knitting device for plating with compound needles on a circular knitting machine is described herein. At least two yarns are inserted into the hook area of a compound needle. A sinker is moved in such a way relative to a knock-over edge disposed immovably on a cylinder that the sinker, by way of a guide means, guides at least one of the yarns further into the hook area of the compound needle, in the direction of the needle shank, and in doing so keeps the yarns separated. The sinker furthermore moves, in the longitudinal direction and the elevational direction, in such a
(Continued)

manner relative to the knock-over edge that the guide means performs a movement which, at least section-wise, tracks at least one yarn.

12 Claims, 3 Drawing Sheets

(58) Field of Classification Search
USPC ..... 66/104, 105, 107, 136
See application file for complete search history.

(56) References Cited

U.S. PATENT DOCUMENTS

| | | | | | |
|---|---|---|---|---|---|
| 3,643,472 | A | * | 2/1972 | Apprich | D04B 15/14 66/106 |
| 5,010,744 | A | * | 4/1991 | Kawase | D04B 15/06 66/93 |
| 5,713,220 | A | * | 2/1998 | Seino | D04B 15/06 66/106 |

FOREIGN PATENT DOCUMENTS

| | | | | | |
|---|---|---|---|---|---|
| EP | 3290555 | A1 | * | 3/2018 | D04B 35/06 |
| GB | 294199 | | | 12/1929 | |
| GB | 294199 | A | * | 12/1929 | D04B 9/34 |
| GB | 294199 | A | | 12/1929 | |

OTHER PUBLICATIONS

Extended European Search Report and Written Opinion dated Sep. 24, 2019, in corresponding European Application No. 19180536.5, with machine English translation (20 pages).
European Patent Office International Extended Search Report for EP 19180536.5-1018 dated Sep. 24, 2019; 3 pages.
European Patent Office International Search Report for PCT/EP2020/064922 dated Aug. 20, 2020; 6 pages.
The State Intellectual Property Office of People's Republic of China, The First Office Action for CN Application No. 202080044478.8 dated Oct. 27, 2022; 7 pages.

* cited by examiner

METHOD AND KNITTING DEVICE FOR PLATING ON A CIRCULAR KNITTING MACHINE EQUIPPED WITH COMPOUND NEEDLES

CROSS REFERENCE TO RELATED APPLICATIONS

This patent application is the national phase of PCT/EP2020/064922, filed May 28, 2020, which claims the benefit of European Patent Application No. 19180536.5, filed Jun. 17, 2019.

TECHNICAL FIELD

The present invention relates to a method and a knitting device for the circular knitting of plated knit goods with compound needles.

BACKGROUND

Many different embodiments both of circular knitting machines fitted with compound needles and of circular knitting machines for the manufacture of plated knit goods are known from the prior art.

DE69024050T2 shows a circular knitting machine with a downwardly sloping holding-down and knocking-over sinker, which holds a base yarn and a pile yarn also during loop-forming. The disclosed procedure is intended to obviate the need for adjusting the settings when the knitting density or type of yarn is changed. It is stated in addition that, instead of the latch needles shown, it is also possible to use compound needles.

In practice, however, it has been found that insertion of more than one yarn into the hook of compound needles is difficult on account of the missing latch-closure movement. The latch-closure movement is the closing movement of the latch towards the hook, by which the yarns lying outside but adjacent to a hook area may be guided by the latch into the hook area. Experience has shown that, for this reason, compound needles are not used in the production of plated knit goods.

DE4131508A1 describes, among other things, the production of a pile knit fabric with compound needles and yarn-insertion means. The yarn-insertion means is intended to enclose the two yarns within an insertion area and serves, at least for the pile yarn, as knock-over edge.

None of the above-mentioned publications discloses a method, a knitting machine or knitting tools, such as sinkers, for the production of plated knit goods on a circular knitting machine fitted with compound needles. In the present invention, the term "plated knit goods" refers, in particular, to knit goods which do not have any loops projecting above the surface of the base fabric. Knit goods having projecting loops of this kind are referred to as pile fabrics.

SUMMARY

Starting from the described prior art, the aim of the present invention is to provide a method and a knitting device with which plated knit goods can be manufactured reliably and with a high level of productivity on a circular knitting machine fitted with compound needles.

In the method according to the invention, at least two yarns are introduced into the hook area of a compound needle. A prior art yarn guide may be used for this purpose. A sinker is moved in such a manner relative to a knock-over edge disposed immovably at a cylinder and extending in a longitudinal and in a transverse direction that, by way of a guide means for separated guidance of the yarns, the sinker guides at least one of the yarns further into the hook area of the compound needle, towards the needle shank of a compound needle, and in doing so keeps the yarns separated. The sinker moves parallel to the knock-over edge in the longitudinal direction and at right angles thereto in the elevational direction, which is at right angles to the longitudinal and to the transverse direction, in such a way that the guide means performs a movement which, at least section-wise, tracks at least one yarn. Preferably, at least one elastic and at least one non-elastic yarn are inserted into the hook area of a compound needle.

By means of the movement of a guide means, as provided for in the invention, all the yarns are captured securely by the hook of the compound needle and, furthermore, maintain the required sequence and/or position relative to the other yarn(s). Additionally, on account of the tracking movement, the elastic yarn, in particular, is not displaced unnecessarily from its path and so undesirable vibration is prevented. Consequently, the required sequence or position of the yarns relative to one another is maintained yet more reliably, even at high production speeds. The use of compound needles furthermore enables a higher production speed than is achievable with latch needles.

The sinker tracks the yarn, preferably at least section-wise or at least until the yarns are securely encompassed by the hook of the compound needle. As used here, the term "tracking movement" means that the sinkers move on a path such that the guide means arranged on the sinker moves, at least intermittently, along a path that corresponds or at least closely approximates to the path of at least one of the yarns. A yarn guide is arranged immovably, relative to a machine frame as fixed point, within the machine. The yarns run, at least predominantly, from their last deflection point on the yarn guide obliquely downwards to the location at which loop formation takes place. The path on which the yarns run obliquely downwards and along which the yarn is supplied is often stationary. This means that the yarns, which are under tensile stress, apparently do not move in relation to the machine frame. Contrary to this, the needles and sinkers are moved past the yarn guide by the rotary motion of the cylinder and of the sinker holder. The needles additionally perform a rising and retracting movement in a direction parallel to the cylinder axis in order to capture the yarns with their hook as they slide past. According to the invention, the sinkers perform, in addition to the rotary movement imposed upon them by the sinker holder, at least one advancing movement of such a kind that the movement path of the sinkers' guide means tracks the obliquely downward-running path of at least one of the yarns, and the movement path, or the trajectory, of the guide means corresponds section-wise to the path of the yarns. As the yarns are guided, at least in part, by the sinkers' guide means and, in particular, are guided further into the hook area of the compound needle, the stationary path of at least one yarn is preferably not a straight path from the yarn guide to the loop-forming location but has, at the first contact position with the sinker's guide means, at least one deflection point, which is not formed if the sinkers' guide means are not engaging with the yarn.

Plating may refer, in particular, to a knitting process in which at least one elastic yarn and at least one non-elastic yarn are used in order to produce highly stretchable knit goods, in particular for the field of sport. The formation of a pile knit fabric is not subject matter of this invention.

While cotton, for example, is deemed a non-elastic yarn, elastane is considered in this invention to be a typical elastic yarn.

The hook area of a compound needle is understood to be a space limited for one part by the inner face of the hook and the upper end of the needle shank and, for the other, by an imaginary line which runs, parallel to the needle's direction of movement, from the needle's hook tip to the upper edge of the needle shaft. During its retracting movement, a needle is able to enclose a yarn disposed in this space with its hook and form a loop.

The knock-over edge extends in a longitudinal and in a transverse direction. The knock-over edge extends to a greater extent in the longitudinal direction than in the transverse direction. The knock-over edge may be disposed integrally with the cylinder or else as a separate part connected immovably to the cylinder.

The tracking movement may be performed linearly or as a swaying movement, that is, curvilinearly. Combinations thereof may also be advantageous.

After the movement during which the sinker tracks the at least one elastic yarn or at least one non-elastic yarn, at least section-wise, the sinker moves back in the longitudinal and elevational directions in order to not to touch any yarn during knocking-over of a loop. In particular during pile formation, a movement of this kind is impossible because the pile loop has to be held by the sinker during loop-forming. Thanks to this additional period of time during which the sinker can perform movements, and in contrast to pile formation with sinkers, a flexible sequence of sinker movements is possible; for example, the sinker may be retracted prematurely in order to facilitate knocking-over of a loop or at least not to hinder it. The sinker may be retracted during loop-forming or may already have been retracted, since contact with the yarns in order to form a pile loop is not necessary.

A holding-down means may be advanced, i.e. rendered functional. Frequently, holding down is also referred to as enclosing. Accordingly, sinkers which have the function of holding down or enclosing are often called holding-down sinkers. The necessity of holding down the loop derives from the fact that, otherwise, the loop is raised by the needle when the needle rises, and this produces a non-uniform loop structure. Friction-based raising of loops does not occur uniformly. The holding-down means may be arranged on the sinker or on an additional sinker. The holding-down means may be in its fully advanced position when the compound needle begins to rise, taking the loop suspended thereon with it. The holding-down means may be withdrawn when the compound needle has reached its uppermost reversal position. In the withdrawn state, the holding-down means is non-functional, i.e. makes no contact with the yarns. If it is arranged on an additional sinker, the holding-down means may be moved from the interior or the exterior over the hook area of the compound needle. The arrangement of an additional sinker in the knitting system enables the sinker with the guide means to be moved even more flexibly with regard to space and time, and, for example, makes it possible to coordinate the yarn tracking movement even better with the path of the respective yarn.

Once the compound needle has risen to its uppermost position, the holding-down and the guide means are retracted so that yarns can be inserted anew into the hook area of the compound needle and be moved by the hook of the compound needle to the knock-over edge.

The knitting device according to the invention for plating with compound needles comprises a cylinder with an immovably arranged knocking-over edge, which extends in a longitudinal and in a transverse direction, compound needles, at least two yarns and at least one sinker. The sinker comprises a guide means for separately guiding the at least two yarns. The sinker is disposed movably relative to the knocking-over edge, moving parallel thereto in the longitudinal direction and at right angles thereto in the elevational direction, which is at right angles to the longitudinal and to the transverse direction, in order to enable the sinker, by way of a movement the guide means that tracks the yarn, to guide at least one yarn further into the hook area of the compound needle, towards the needle shank, and to keep it separated from the at least one other yarn (4, 5). The knitting device preferably comprises at least one elastic and at least one non-elastic yarn.

By means of the arrangement, as provided for in the invention, of a sinker with a guide means, all the yarns are captured securely by the hook and, furthermore, maintain the required sequence and/or position relative to the other yarn(s). Additionally, on account of the tracking movement, the elastic yarn, in particular, is not displaced unnecessarily from its path and so undesirable vibration is prevented. Consequently, the required sequence of the yarns is maintained yet more reliably, even at high production speeds. As a result of the knocking-over function being assigned to a stationary element and the holding-down and inserting function to at least one separate element, standstill of the sinkers during loop-forming is not required and these may be moved flexibly, not only in terms of space but also time.

The guide means on the sinker may be formed by an end edge of the at least one sinker. The end edge may comprise edge sections that are parallel to the elevational direction during every movement phase of the at least one sinker. Elevations and/or depressions that guide the yarns and/or keep them separate may be disposed between the edge sections. In particular, three or more yarns may be guided into the hook area and kept separated by the sinker.

The at least one sinker may comprise a holding-down means, which is formed by an edge of the at least one sinker. When the at least one sinker has been advanced, the edge that may form the holding-down means of the at least one sinker may run parallel to the knock-over edge.

The holding-down means may be formed on at least one additional sinker. The additional sinker may be arranged to be movable in the longitudinal direction, from the exterior or the interior, over the hook portion of the compound needle.

The knitting device may comprise equipment, for example cams and means for driving the cylinder, for initiating the movements of knitting tools such as compound needles, sliders and sinkers. The knitting device may furthermore comprise yarn guides and other yarn-feed units.

DETAILED DESCRIPTION

Figure 1:
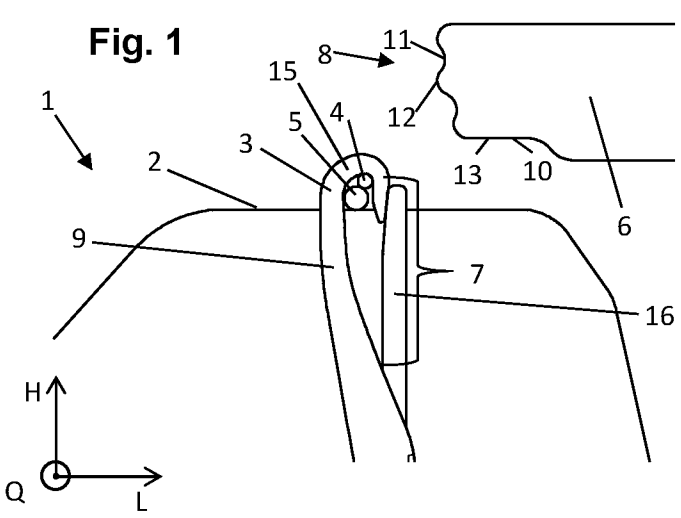
FIG. 1 is a symbolic representation of a knitting system according to the invention at a given moment during the loop-forming process.

FIG. 1 is a symbolic representation of a knitting system 1 according to the invention at a given moment during the loop-forming process. The compound needle 3 has knocked over a loop and already begun to rise. The sinker 6 is in the position of maximum retraction. An elastic yarn 4 and a non-elastic yarn 5, which were formed into loops of a given depth shortly beforehand, are enclosed in the hook of the compound needle 3. The non-elastic yarn 5 is underneath the elastic yarn 4 and is still touching the knock-over edge 2. The hook area 7 of the compound needle 3 is symbolized with curly brackets. In this state, the hook area 7 of the compound needle 3 is completely closed by the hook 15, the needle shank 9 and the slider 16. The sinker 6 comprises a guiding portion 8 at its left-hand end in FIG. 1, which has, for example, two edge sections 11 and 12 running parallel to the elevational direction H. Two depressions, each bounded by an elevation, are formed on the sinker 6 shown in FIG. 1 with the edge sections 11 and 12, which run parallel to the elevational direction H. The sinker 6 furthermore comprises a holding-down means 10 formed by an edge of the sinker 6 that is downwardly directed, in the elevational direction H. The longitudinal direction L, the elevational direction H and the transverse direction Q are symbolized by a coordinate system.

FIGS. 2 to 8 merely show the knitting system 1 of FIG. 1 at other stages of the loop-forming process. The coordinate system and some of the reference numerals are therefore not shown and explained again in these drawings.

Figure 2:
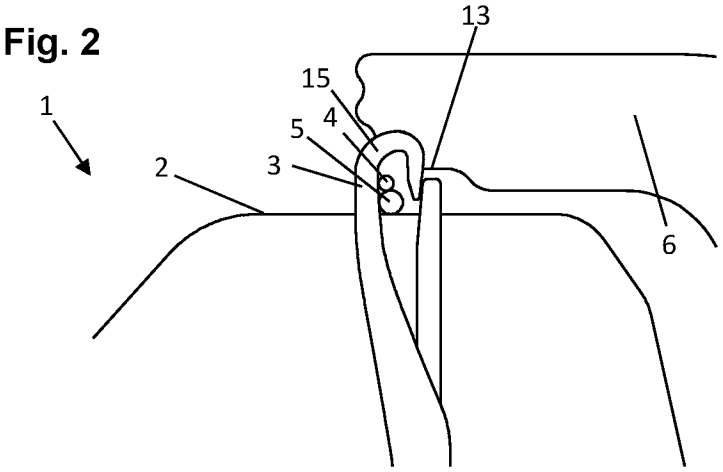
FIG. 2 shows the knitting system of FIG. 1 at a second moment in time.

In FIG. 2, the compound needle 3 has continued rising and the yarns 4 and 5 are no longer held down on the knock-over edge 2 by the hook 15. The sinker 6 has advanced in order to hold down the yarns 4 and 5 with its edge 13 and prevent the yarns from being raised along with the compound needle 3.

Figure 3:
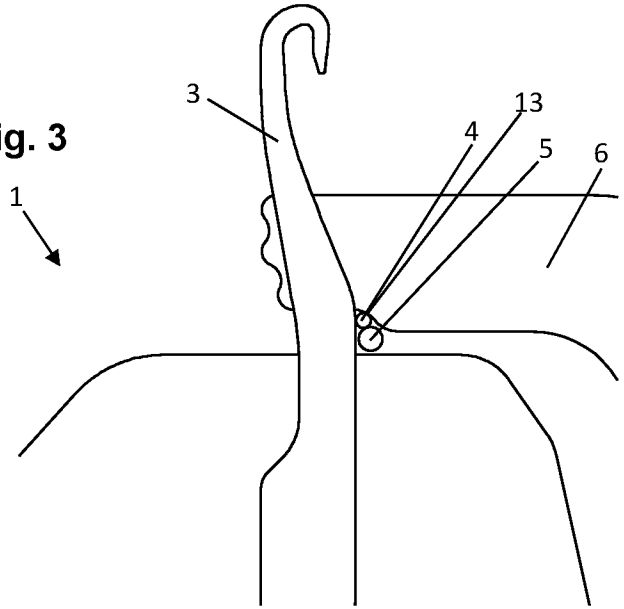
FIG. 3 shows the knitting system of FIG. 1 at a third moment in time.

In FIG. 3, the compound needle 3 has completed its upward movement and reached its uppermost position. The yarns 4 and 5 have left the hook area of the compound needle 3 and are being held down by the edge 13 of the sinker 6. The yarns 4 and 5 have overcome the upward incline of the needle 3, enabling the slider 16 to close off the hook area 7 and the yarns 4 and 5 to be knocked over via the slider 16 and the hook 15.

Figure 4:
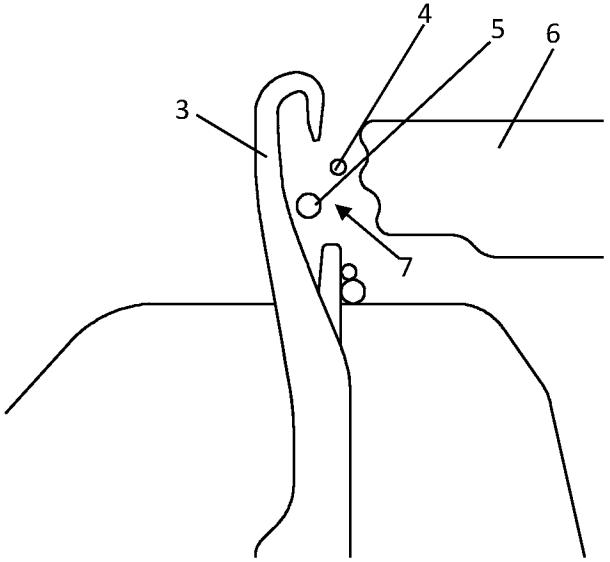
FIG. 4 shows the knitting system of FIG. 1 at a fourth moment in time.

In FIG. 4, the compound needle 3 has begun its retraction movement and the sinker 6 is in its retracted position so that yarns 4 and 5 can be introduced anew into the hook area 7 of the compound needle 3.

Figure 5:
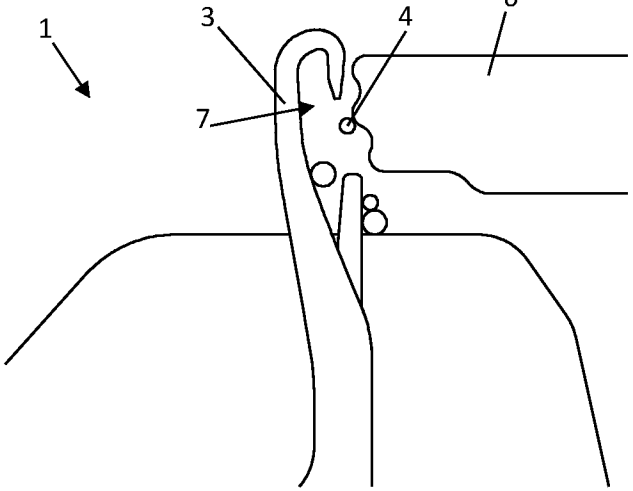
FIG. 5 shows the knitting system of FIG. 1 at a fifth moment in time.

In FIG. 5, the compound needle 3 has continued its retraction movement and the sinker 6 has advanced sufficiently for it to begin touching the yarn 4 with its guide means 8.

Figure 6:
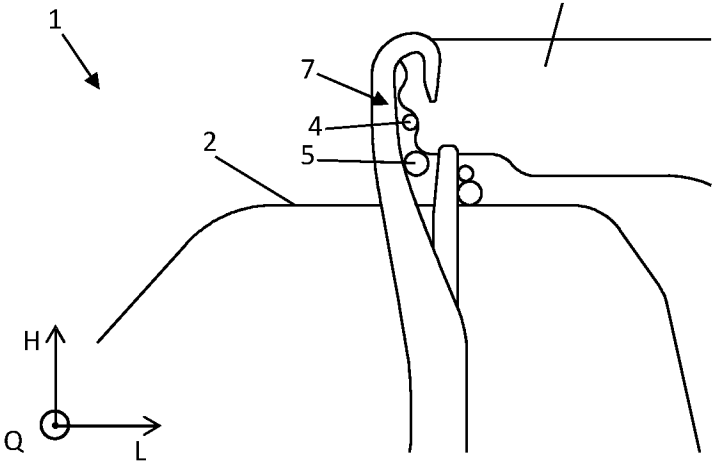
FIG. 6 shows the knitting system of FIG. 1 at a sixth moment in time.

In FIG. 6, it is clearly evident that the sinker 6 has advanced further in the longitudinal direction L and has furthermore approached the knock-over edge 2 in the elevational direction H. In this position, the sinker 6 secures the yarn 4 in the hook area 7 and also keeps the yarns 4 and 5 separated.

Figure 7:
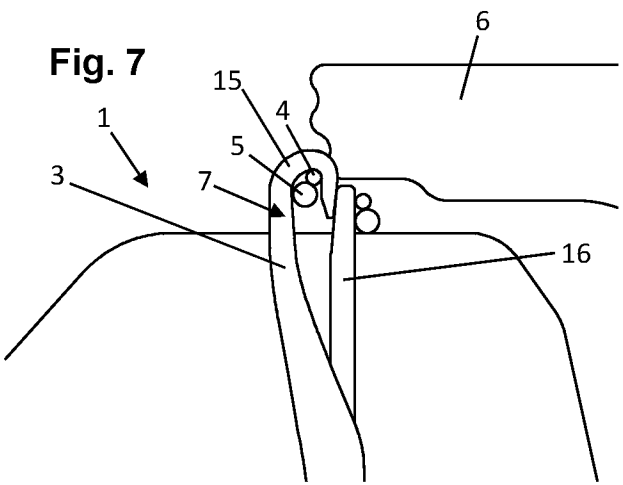
FIG. 7 shows the knitting system of FIG. 1 at a seventh moment in time.

In FIG. 7, finally, the hook area 7 with the two yarns 4 and 5 is closed by the slider 16 and, on account of the compound needle 3 having continued its retraction movement and moved further down, the two yarns 4 and 5 have come to lie in the right order and the right position relative to one another in the hook 15 of the compound needle 3.

Figure 8:
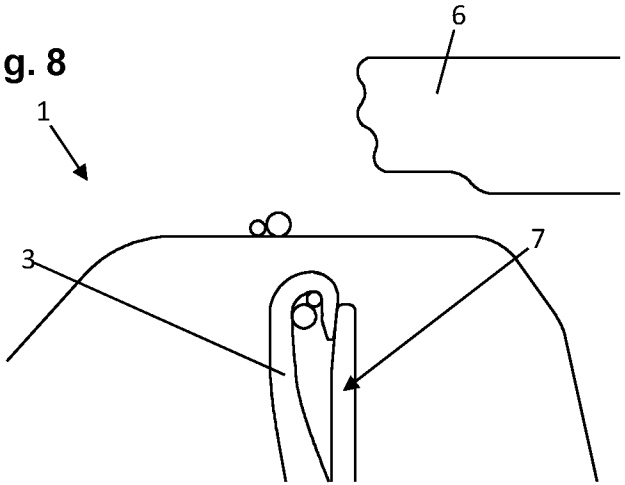
FIG. 8 shows the knitting system of FIG. 1 at an eighth moment in time.

In FIG. 8, the compound needle 3 has reached its lowermost position and knocked over the last loop. The sinker 6 is already in its retracted position, so that it no longer covers the hook area 7 in the elevational direction and was unable to prevent loop knock-over.

Figure 9:
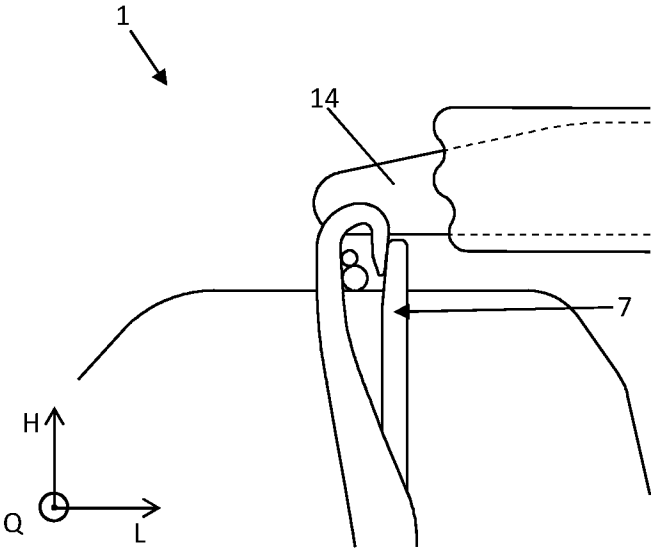
FIG. 9 shows a modified knitting system according to the invention, having an additional sinker that can grasp from the exterior over the hook area of the compound needle.

FIG. 9 shows a modified knitting system 1 according to the invention, comprising an additional sinker 14 that can grasp, in the longitudinal direction L, from the exterior over the hook area 7 of the compound needle 3.

Figure 10:
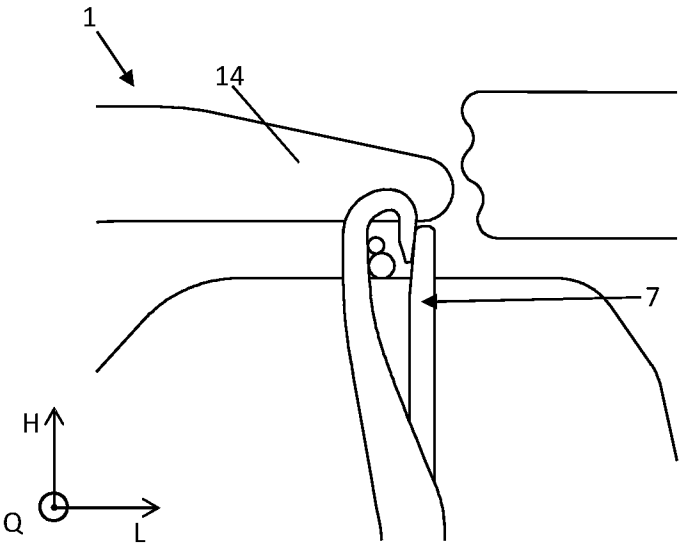
FIG. 10 shows a further modified knitting system according to the invention, having an additional sinker that can grasp from the interior over the hook area of the compound needle.

FIG. 10 shows another modified knitting system 1 according to the invention, comprising an additional sinker 14 that can grasp, in the longitudinal direction L, from the interior over the hook area 7 of the compound needle 3.

| List of reference numerals | |
|---|---|
| 1 | Knitting device |
| 2 | Knock-over edge |
| 3 | Compound needle |
| 4 | Elastic yarn |
| 5 | Non-elastic yarn |
| 6 | Sinker |
| 7 | Hook area of the compound needle (3) |
| 8 | Guide means of the sinker (6) |
| 9 | Needle shank of the compound needle (3) |
| 10 | Holding-down means |
| 11 | Edge section on the sinker (6) |
| 12 | Edge section on the sinker (6) |
| 13 | Edge on the sinker (6), which forms the holding-down means (10) |
| 14 | Additional sinker |
| 15 | Hook |
| 16 | Slider |
| L | Longitudinal direction |
| Q | Transverse direction |
| H | Elevational direction |

The invention claimed is:

1. A method for plating with compound needles on a circular knitting machine, the method comprising:

inserting at least two yarns (4, 5) into a hook area (7) of a compound needle (3);

moving at least one sinker (6) relative to a knock-over edge (2) disposed immovably on a cylinder and extending in a longitudinal direction (L) and in a transverse direction (Q) such that, by way of a guide means (8), the at least one sinker (6) guides at least one of the at least two yarns (4, 5) further into the hook area (7) of the compound needle (3), towards a shank (9) of the compound needle (3), and in doing so keeps the at least two yarns (4, 5) separated; and moving the at least one sinker (6) in the longitudinal direction (L) and in an elevational direction (H), which is orthogonal to the longitudinal direction (L) and to the transverse direction (Q), towards the knock-over edge (2) while the at least one of the at least two yarns is in contact with the guide means (8) such that the guide means (8) performs a movement which tracks, at least section-wise, the at least one of the at least two yarns (4, 5).

2. The method according to claim 1, wherein the at least two yarns (4, 5) comprise at least one elastic yarn (4) and at least one non-elastic yarn (5).

3. The method according to claim 1, further comprising moving the at least one sinker (6) back in the longitudinal direction (L) and in the elevational direction (H) after the movement during which the at least one sinker (6) tracks the at least one of the at least two yarns (4, 5), at least section-wise, in order to not to touch any yarn during knocking-over of a loop.

4. The method according to claim 1, further comprising moving a holding-down means (10) in the longitudinal direction (L) over the hook area (7) of the compound needle (3) after a loop has been knocked over.

5. The method according to claim 4, further comprising retracting the holding-down means (10) and the guide means (8) once the compound needle (3) has risen to an uppermost position, to allow the at least two yarns (4, 5) to be inserted into the hook area (7) of the compound needle (3) and moved to the knock-over edge (2).

6. A knitting device (1) for plating with compound needles, the knitting device comprising:

a cylinder with an immovably disposed knock-over edge (2), which extends in a longitudinal direction (L) and a transverse direction (Q), a plurality of compound needles (3); and at least one sinker (6), which has guide means (8) for separated guidance of at least two yarns (4, 5);

wherein the at least one sinker (6) is disposed movably in the longitudinal direction (L) and an elevational direction (H) relative to the knock-over edge (2) and wherein the at least one sinker is configured such that it contacts at least one yarn of the at least two yarns (4,5) while moving longitudinally and elevationally in order to enable said at least one sinker, by way of a movement of the guide means (8) that tracks the at least one yarn of the at least two yarns (4, 5), to guide the at least one yarn of the at least two yarns (4, 5) further into a hook area (7) of one of the plurality of compound needles (3) and toward a shank thereof, and to keep the at least one yarn of the at least two yarns (4, 5) separate from another of the at least two yarns (4, 5).

7. The knitting device (1) according to claim 6, wherein the guide means (8) is formed by an end edge of the at least one sinker (6), said end edge comprising edge sections (11, 12) that are parallel to the elevational direction (H) during every movement phase of the at least one sinker (6), and further comprising elevations and/or depressions disposed between the edge sections (11, 12) configured to guide the at least two yarns (4, 5) and/or keep them separate.

8. The knitting device (1) according to claim 6, further comprising a holding-down means (10).

9. The knitting device (1) according to claim 8, wherein the holding-down means (10) is formed by an edge (13) of the at least one sinker (6).

10. The knitting device (1) according to claim 9, wherein when the at least one sinker (6) is in an advanced position, the edge (13) that forms the holding-down means (10) of the at least one sinker (6) extends parallel to the knock-over edge (2).

11. The knitting device (1) according to claim 8, wherein the holding-down means (10) is formed on at least one additional sinker (14).

12. The knitting device (1) according to claim 11, wherein the at least one additional sinker (14) is movable in the longitudinal direction (L) over the hook area (7) of the compound needle (3).

* * * * *